US006026714A

United States Patent [19]

Chang

[11] Patent Number: 6,026,714

[45] Date of Patent: Feb. 22, 2000

[54] ADJUSTABLE WRENCH

[76] Inventor: Jong-Shing Chang, No. 5, Chang Ma Street, Ma Hsing Village, Shiow Shoei Shi, Chang Huah, Taiwan

[21] Appl. No.: 09/095,113

[22] Filed: Jun. 10, 1998

[51] Int. Cl.[7] ..... B25B 13/12

[52] U.S. Cl. ..... 81/100; 81/109; 81/412

[58] Field of Search ..... 81/100, 101, 106, 81/109, 405, 407, 408, 409, 409.5, 411–412

[56] References Cited

U.S. PATENT DOCUMENTS

| | | | |
|---|---|---|---|
| 778,814 | 12/1904 | Van Horn | 81/100 |
| 788,772 | 5/1905 | Johnson | 81/100 |
| 1,169,379 | 1/1916 | Brown | 81/100 |
| 1,500,314 | 7/1924 | Hacheney . | |
| 1,577,789 | 3/1926 | Conway . | |
| 1,626,309 | 4/1927 | Thurley | 81/100 |
| 1,900,358 | 3/1933 | Mead | 81/100 |
| 2,645,966 | 7/1953 | Mead | 81/100 |
| 4,893,528 | 1/1990 | Chung-Hsing | 81/100 |

FOREIGN PATENT DOCUMENTS

| | | | |
|---|---|---|---|
| 112516 | 9/1944 | Sweden | 81/412 |
| 10112 | of 1912 | United Kingdom . | |
| 155130 | 12/1920 | United Kingdom | 81/100 |
| 160513 | 3/1921 | United Kingdom . | |

*Primary Examiner*—D. S. Meislin
*Attorney, Agent, or Firm*—Browdy and Neimark

[57] ABSTRACT

An adjustable wrench is composed of a handle and a clamping member fastened pivotally with the handle and provided with two clamping surfaces forming therebetween an angle of 120 degrees. The clamping member is capable of turning on a pivoting point which is located at the center of the pivoting position of a clamped portion of the handle. The pivoting position has a horizontal width which is 3–3.5 times a distance between a longitudinal line of the pivoting point and a longitudinal line passing the curvature center of an arcuate lower clamping surface of the clamped portion of the handle. The arcuate lower clamping surface has a curvature radius which is 2.5–3.5 times a distance between the two longitudinal lines. The arcuate lower clamping surface has an arc line length corresponding in location to a circle center angle ranging between 70 and 90 degrees. When the handle is exerted on by an external force, the workpiece is held securely by a clamping force which is directly proportional in strength to the external force.

9 Claims, 5 Drawing Sheets

ADJUSTABLE WRENCH

FIELD OF THE INVENTION

The present invention relates generally to a wrench, and more particularly to an adjustable wrench.

BACKGROUND OF THE INVENTION

The conventional adjustable wrenches, such as those which are disclosed in the U.S. Pat. Nos. 1,577,789 and 1,500,314 and the British Patent Nos. 10,112 and 160,513, are defective in design in that the clamped piece, such as a hexagonal nut, is prone to slip away from the jaws of the wrench when the handle of the wrench is exerted on by a force.

SUMMARY OF THE INVENTION

It is therefore the primary objective of the present invention to provide an adjustable wrench free from the shortcoming of the adjustable wrenches of the prior art described above.

It is another objective of the present invention to provide an adjustable wrench suitable for working on the workpieces of various shapes.

It is further another objective of the present invention to provide an adjustable wrenches having a large range of adjustment.

The foregoing objectives of the present invention are attained by an adjustable wrench consisting of a handle and a clamping member fastened pivotally with the handle and provided with two clamping surfaces forming therebetween an angle of 120 degrees. The handle and the clamping member are fastened pivotally such that the clamping member is capable of turning on a pivoting point which is located at the center of the transverse width of a clamped portion of the handle. The transverse width is 3–3.5 times the distance between a longitudinal line through the pivoting point and parallel to the axis of the handle and a longitudinal line also parallel to the axis of the handle passing through the center of an arcuate lower clamping surface of the clamped portion of the handle. The arcuate lower clamping surface has a circular arc with a radius which is 2.5–3.5 times the distance between these two longitudinal lines. The circular arc of the arcuate lower clamping surface having an angle ranging between 70 and 90 degrees. When the handle is exerted on by a force, the workpiece is held securely by a clamping force which is directly proportional in strength to the force exerting on the handle.

DETAILED DESCRIPTION OF THE INVENTION

Figure 7:
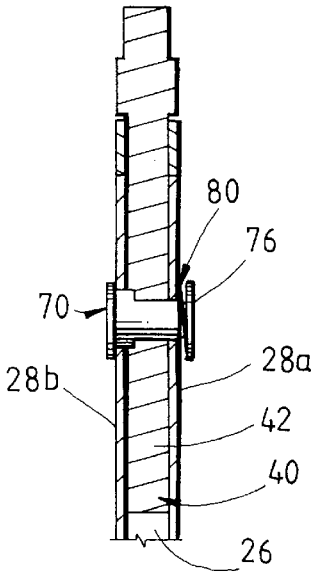
FIG. 7 shows a sectional view of a portion taken along the line 7—7 as shown in FIG. 1.
Figure 1:
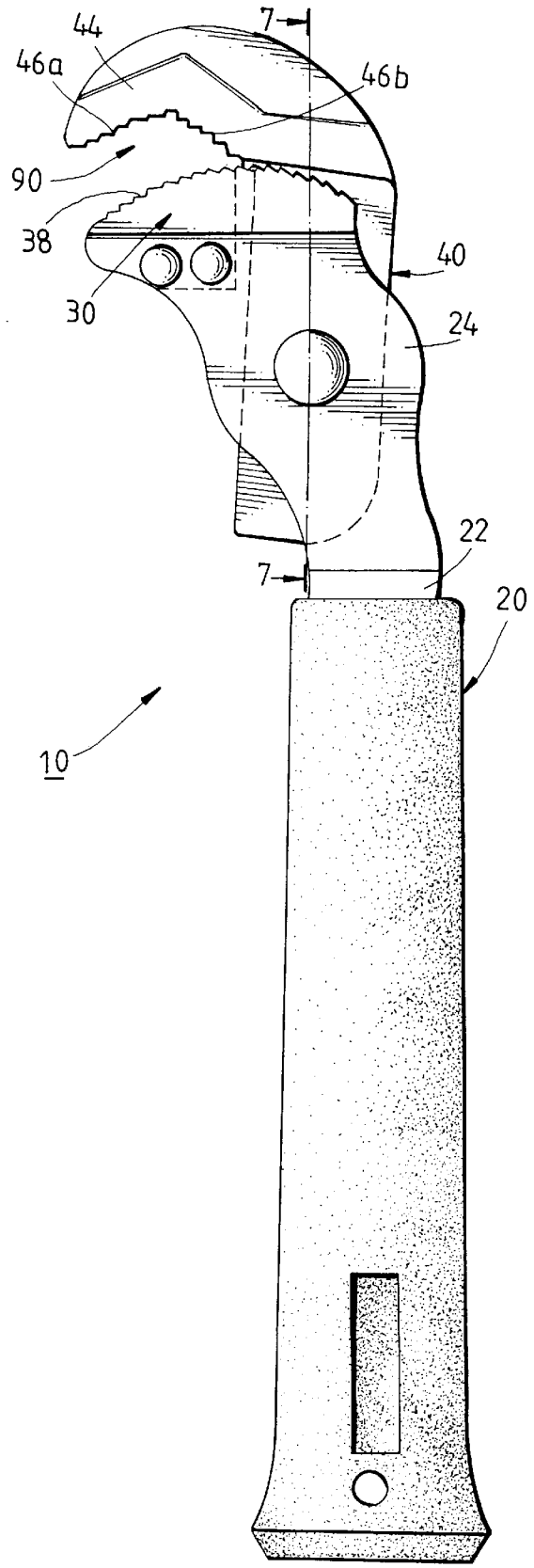
FIG. 1 shows a side view of a preferred embodiment of the present invention.

As shown in FIGS. 1–7, an adjustable wrench 10 embodied in the present invention is composed of a handle 20 and clamping member 40.

The handle 20 has a shaft 22 and a clamped portion 24 located at an upper end of the shaft 22. The clamped portion 24 has a dividing slot 26 extending along the longitudinal axis of the handle 20, two forks 28*a* and 28*b* located at two sides of the dividing slot, and a lower jaw 30 sealing off the dividing slot. In the preferred embodiment of the present invention, the lower jaw 30 has a tongue 32 extending into the dividing slot 26 so as to be fastened with the top ends of the two forks 28*a* and 28*b*.

The clamping member 40 has a projecting arm 42 which is received in the dividing slot 26, and an upper jaw 44 extending from one side of one end of the projecting arm 42. The forks 28*a* and 28*b* are provided respectively with a pivoting hole 50*a*, 50*b*. Each of the pivoting holes has a hole center X which is located at the center of the horizontal width D1(38 mm) of each fork. The projecting arm 42 is provided with a long striplike hole 60 having a long side 60*a* which is provided with three separated arcuate recesses 62*a* 62*b* and 62*c*. A pivot pin 70 has a nut 72 and a shank 74. The shank 74 is put through the pivoting holes and the long striplike hole. The nut 72 is in contact with the peripheral edge of one pivoting hole 50*a*. The shank is put through another pivoting hole 50*b* and is fastened at the end thereof with a circular piece 76.

Figure 3:
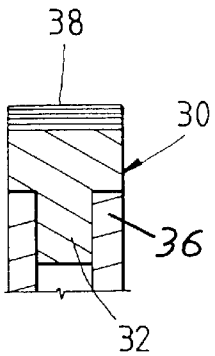
FIG. 3 shows a sectional view of a portion taken along a line 3—3 as shown in FIG. 2.
Figure 4:
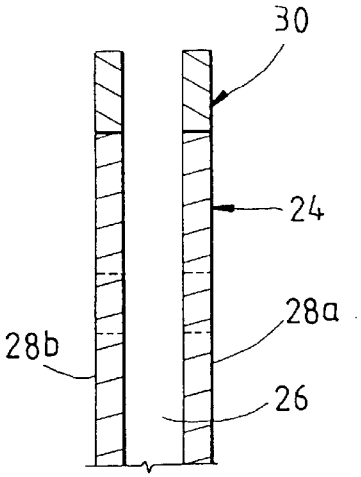
FIG. 4 shows a sectional view of a portion taken along a line 4—4 as shown in FIG. 2.
Figure 5:
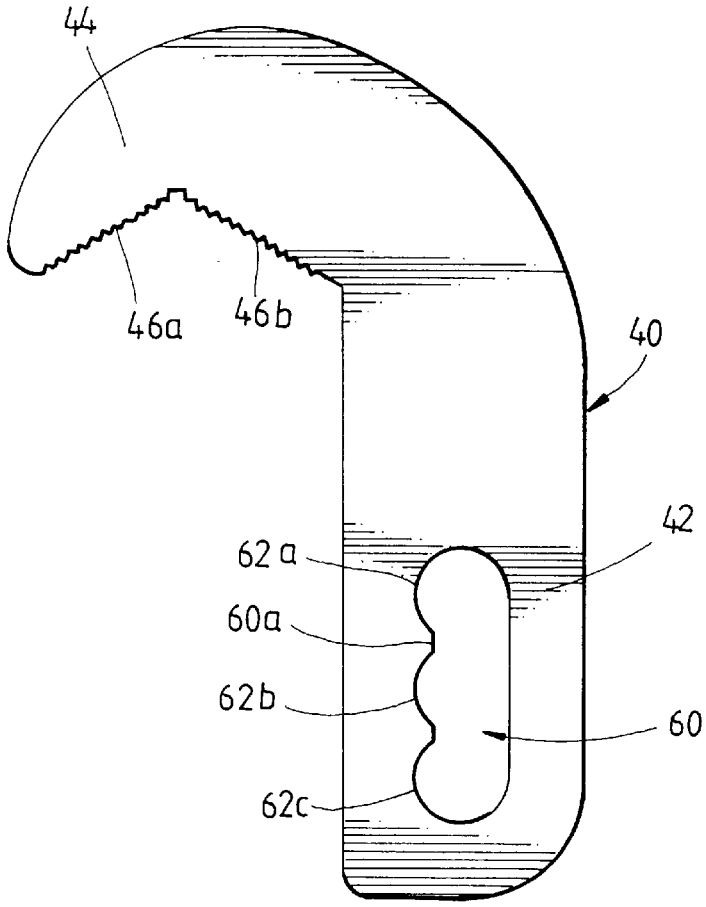
FIG. 5 shows a side schematic view of a clamping member of the preferred embodiment of the present invention.
Figure 6:
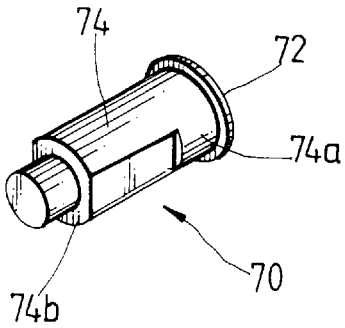
FIG. 6 shows a perspective view of a pivot of the preferred embodiment of the present invention.
Figure 9:
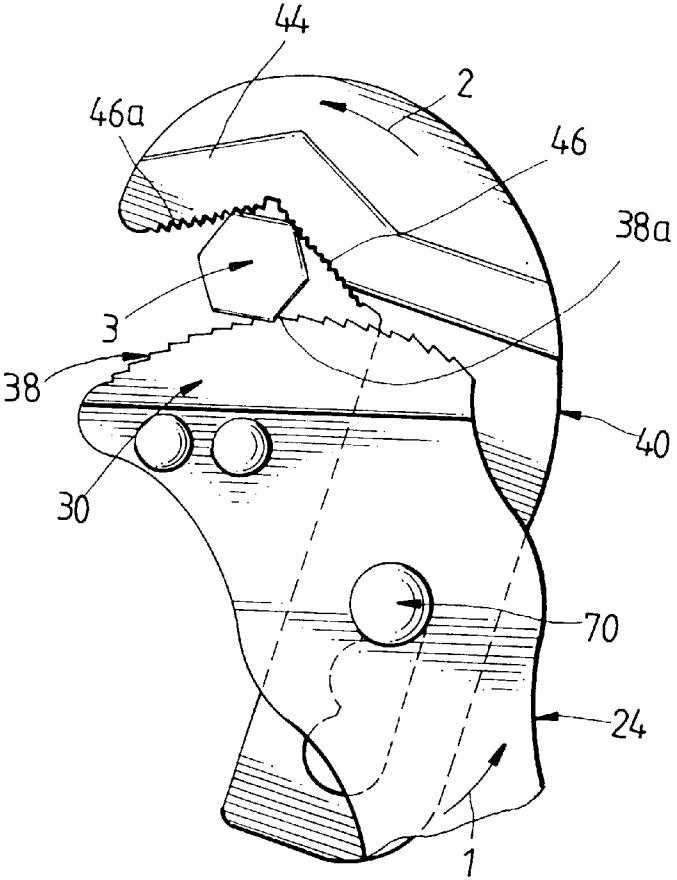
FIGS. 9–11 are another schematic views of the preferred embodiment of the present invention at work.
Figure 8:
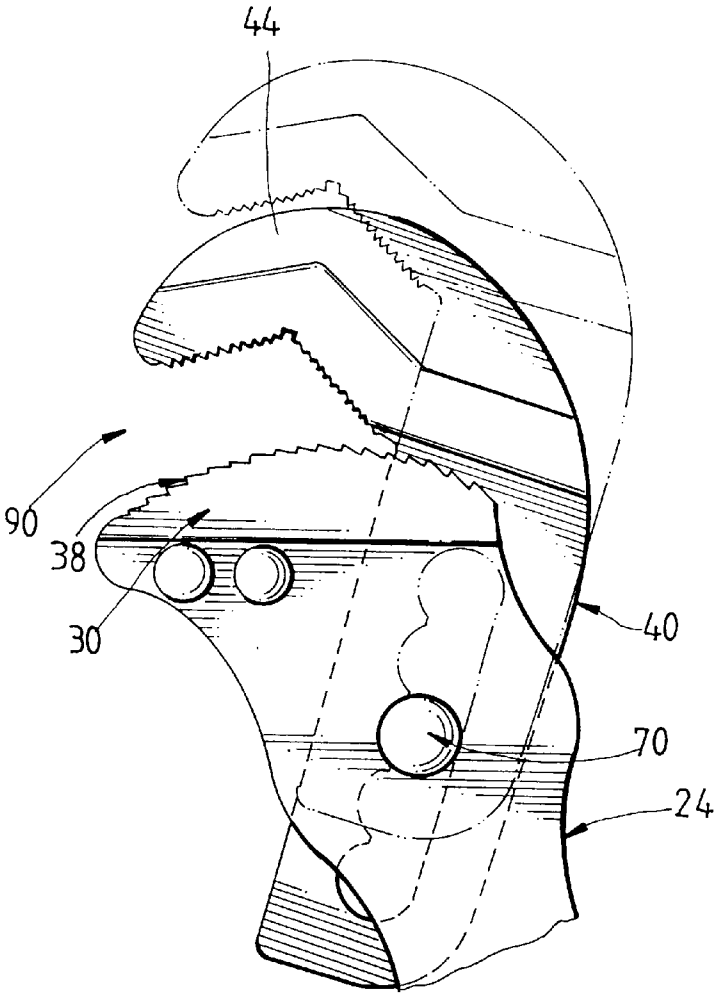
FIG. 8 shows a schematic view of the preferred embodiment of the present invention at work.
Figure 11:
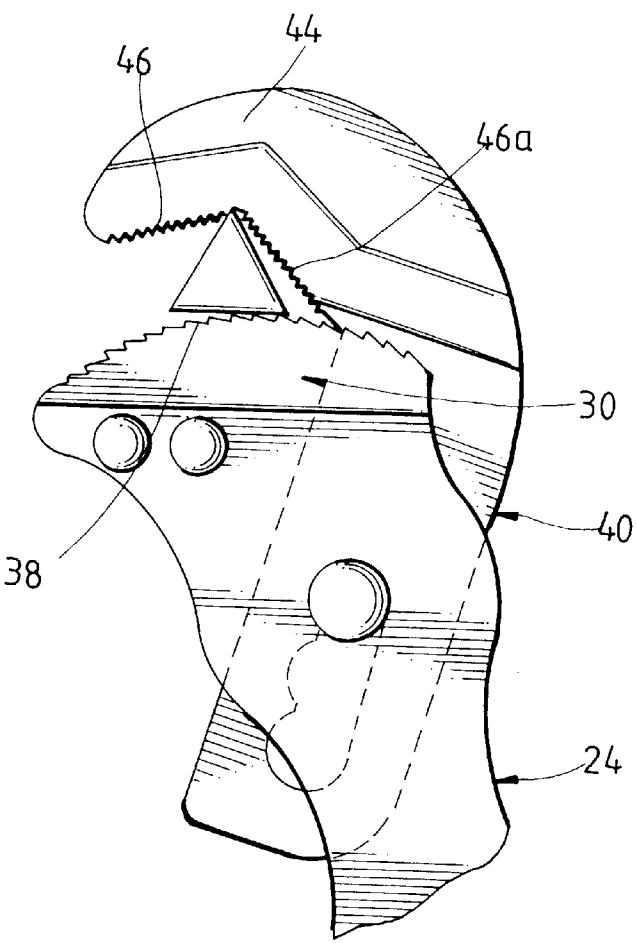
Figure 10:
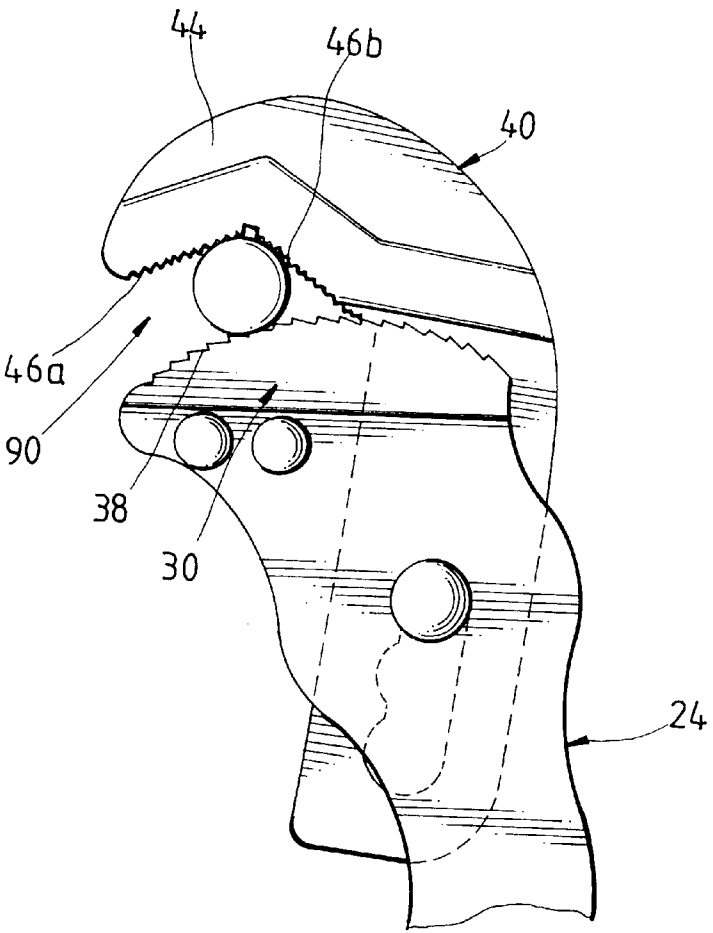

The shank 74 is provided with a columnar portion 74*a* and an oblong portion 74*b* having two, spaced apart flat parallel surfaces, a spiral spring 80 is fitted over the tail end of the shank such that one end of the spring is in contact with the circular piece 76, and that another end of the spring is in contact with the peripheral edge of the pivoting hole 50*b*. The spring 80 has a tension forcing one section of the columnar portion 74*a* to be located in the striplike hole 60 of the clamping member 40. When pivot pin 70 is urged by an external force to the columnar portion 74*a* to be completely separated from the striplike hole 60, the oblong portion 74*b* moves in the striplike hole for changing the position of the clamping member 40. As a result, the clamping member 40 is fastened pivotally with the handle 20 such that an adjustable clamping space 90 is formed therebetween, as shown in FIG. 8. In the preferred embodiment of the present invention, the lower jaw 30 is provided in one side thereof with a recess 36 extending from the dividing slot toward the open end of the clamping space, as shown in FIG. 3, such that the front ends of the upper jaw 44 and the lower jaw 30 are flush with each other.

Figure 2:
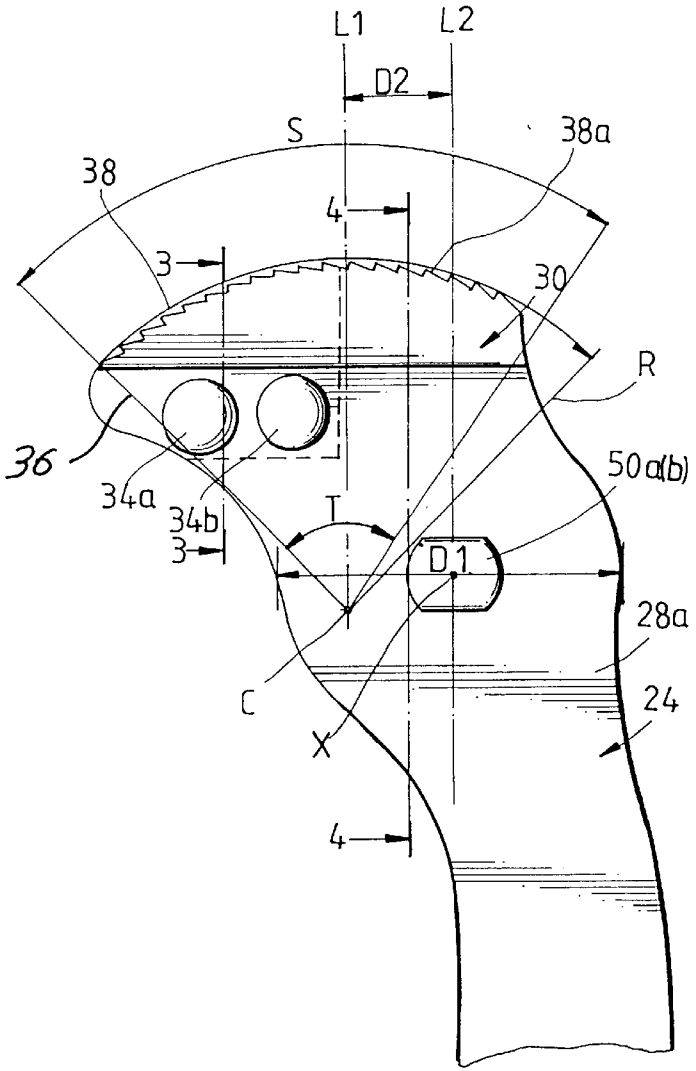
FIG. 2 shows a side schematic view of a handle of the preferred embodiment of the present invention.

The clamping space 90 is formed of three clamping surfaces. One of the clamping surfaces is the arcuate lower clamping surface 38 of the upper end of the lower jaw 30. Other two clamping surfaces are the two upper clamping surfaces 46*a* and 46*b* of the lower end of the upper jaw 44 and forming a clamping angle of 120 degrees. The most important feature of the present invention is that the horizontal width D1 of the position where the center X of the pivoting hole is located is 3–3.5 times the distance D2 between the longitudinal line L1 passing through the curvature center C of the arcuate lower clamping surface 38 and the longitudinal line L2 passing through the center X. The arcuate lower clamping surface 38 has a curvature radius R which is 2.5–3.5 times the distance between the two longitudinal lines. The arc line length S of the arcuate lower clamping surface 38 has an angle T ranging between 70 and 90 degrees. In the preferred embodiment of the present invention, D1=38 mm; D2=12.5 mm; R=40 mm; and T=75°, as shown in FIG. 2. In order to enable each clamping surface to have a greater clamping force, the clamping surface is provided with a plurality of teeth. The lower clamping surface 38 has teeth 38*a* with a pointed end facing the open end of the clamping space.

As shown in FIGS. 8–11, the adjustable wrench 10 has a curvature center located at R, a curvature radius being 40 mm, a circle center angle being 75 degrees, and the upper clamping surface 38 having teeth with a pointed end facing outward. When the handle 20 is exerted on by an external force in a direction indicated by an arrow 1, the clamping member 40 produces a clamping force in a direction indicated by an arrow 2 such that the clamping force is equal to the external force. In the meantime, the clamping space 90 is reduced in dimension. In other words, when the external force is increased, the wrench 10 produces a greater clamping force to hold a workpiece 3, which may be hexagonal, round, or triangular in shape.

What is claimed is:

1. An adjustable wrench comprising:

a handle having at an upper end thereof a clamped portion provided with an arcuate lower clamping surface;

a clamping member fastened pivotally with said upper end of said handle and provided with two upper clamping surfaces forming therebetween an angle of 120 degree, said lower clamping surface forming with each of said upper clamping surface a clamping space having an open end;

wherein said clamping member and said upper end of said handle are fastened pivotally at a pivoting point which is located at a center of a transverse width of said clamped portion and on a first longitudinal line substantially parallel to an axis of the handle, said width being 3–3.5 times a transverse distance between said first longitudinal line and a second longitudinal line substantially parallel to the axis of the handle and passing through a center of said arcuate lower clamping surface of said handle, a circular arc of said arcuate lower clamping surface having a radius which is 2.5–3.3 times said transverse distance, said circular arc of said arcuate lower clamping surface having an angle ranging between 70 and 90 degrees.

2. The adjustable wrench as defined in claim 1, wherein said arcuate lower clamping surface is provided with a plurality of teeth.

3. The adjustable wrench as defined in claim 2, wherein said teeth have a pointed end facing said open end of said clamping space.

4. The adjustable wrench as defined in claim 1, wherein said clamped portion has a dividing slot extending along the direction of said longitudinal axis of said handle, two forks located on opposite sides of said dividing slot, and a lower jaw sealing off said dividing slot; and wherein said lower clamping surface is located at a top end of said lower jaw.

5. The adjustable wrench as defined in claim 4, wherein said lower jaw has a recessed edge extending along said dividing slot toward said open end of said clamping space.

6. The adjustable wrench as defined in claim 4, wherein said clamping member has a protecting arm which is received in said dividing slot, and an upper jaw extending from one side of one end of said protecting arm; and wherein each of said upper clamping surfaces are located on a bottom side of said upper jaw.

7. The adjustable wrench as defined in claim 6, wherein said two forks of said clamped portion are each provided with a pivoting hole having a center which is located at said pivoting point; wherein said protecting arm of said clamping member is provided with a striplike hole; and wherein said handle and said clamping member are fastened pivotally by a pivot pin received in said pivoting holes and said striplike hole.

8. The adjustable wrench as defined in claim 7, wherein said striplike hole is provided in one long side thereof with a plurality of arcuate recesses separated from one another; wherein said pivot pin has a shank which is provided with a columnar portion and an oblong portion having two spaced apart flat parallel surfaces, said columnar portion having an outer diameter greater than a distance between two long sides of said striplike hole and smaller than a distance between a wall of said arcuate recesses and one of said two long sides of said striplike hole, said pivot pin capable of sliding along said striplike hole at such time when said columnar portion of said pivot pin moves away from said striplike hole.

9. The adjustable wrench as defined in claim 6, wherein said shank of said pivot pin has a length greater than a combined depth of said pivoting holes and said striplike hole, said shank having an end provided with a circular piece having an outer diameter greater than a hole diameter of said pivoting hole, said end of said shank provided with a spiral spring fitted thereover such that one end of said spring urges said circular piece, and that another end of said spring urges a peripheral edge of said pivoting hole, and further that one section of said columnar portion is forced by a tension of said spring to remain in said striplike hole of said clamping member, and still further that said columnar portion is completely forced out of said striplike hole at the time when said pivot pin is pushed by an external force to move a distance.

* * * * *